United States Patent [19]

Sumida

[11] 4,364,303

[45] Dec. 21, 1982

[54] AIR OPERATED RECIPROCATING TOOL

[76] Inventor: Kunio A. Sumida, 1114 N. Kenter Ave., Los Angeles, Calif. 90049

[21] Appl. No.: 184,928

[22] Filed: Sep. 8, 1980

[51] Int. Cl.[3] ..... F01L 23/00; F01B 9/00

[52] U.S. Cl. ..... 91/329; 91/341 R; 91/348; 92/137; 51/170 TL

[58] Field of Search ..... 92/137; 91/348, 329, 91/341 R; 51/170 TL

[56] References Cited

U.S. PATENT DOCUMENTS

| | | | |
|---|---|---|---|
| 1,155,282 | 9/1915 | Shoner | 91/329 |
| 2,130,982 | 9/1938 | Gartin | 92/137 |
| 2,864,342 | 12/1958 | Ziegelmeyer | 92/137 |
| 2,890,682 | 6/1959 | Swanson | 91/329 |
| 3,214,823 | 11/1965 | Hendrickson | 91/328 |

FOREIGN PATENT DOCUMENTS

| | | | |
|---|---|---|---|
| 312970 | 8/1971 | U.S.S.R. | 92/137 |

*Primary Examiner*—Paul E. Maslousky
*Attorney, Agent, or Firm*—Charles H. Schwartz; Ellsworth R. Roston

[57] ABSTRACT

An air operated reciprocating tool, including, an air operated double ended piston positioned within a cylinder for reciprocation within the cylinder, a valve assembly in communication with a source of air for controlling the application of the source of air in alternation to opposite portions of the piston for reciprocation of the piston, a shoe member for supporting a tool and with the shoe member mounted for sliding motion, and belt means forming a loop for interconnecting the ends of the double ended piston and the shoe member and with the belt means supported by pulley members located adjacent the ends of the double ended piston and with the reciprocating motion of the double ended piston transmitted to reciprocating motion of the shoe member.

21 Claims, 7 Drawing Figures

22
66
76
78
92
84
88
96
86
98
80
82
62
64
68
94
70
106
100
90
72
74
130
152
154
156
140
148
14
18
16
174
124
128
112
120
116
142
150
110
118
114

22
66
76
78
84
86
88
92
96
98
108
94
82
80
68
62
64
70
100
90
72
74
130
152
154
146
138
14
18
16
148
140
156
128
124
112
120
116
134
142
150
110
118
114
132
136
144

AIR OPERATED RECIPROCATING TOOL

This invention relates to an air operated reciprocating tool. Specifically, the air operated reciprocating tool of the present invention may be used for sanding, filing, sawing, etc., or any other operation which may be produced with a reciprocating motion. In particular, the air operated reciprocating tool of the present invention is very simple in construction and has extremely low levels of vibration providing for a long life for the tool.

Prior art air operated reciprocating tools generally include gears or levers to transmit reciprocating motion between different elements such as a piston and a tool holder in the reciprocating tool. Because of the use of gears or levers these prior art reciprocating tools include play between the various elements providing for the reciprocation of the tool. Because of the play between elements it is difficult to provide for a fine control in a valving structure which controls the application of air to the piston which in turn provides for the reciprocating motion of the piston. In particular, the inherent play in the prior art devices may provide for changes in the timing of the application of air at the different portions in a cycle of operation. Such changes in timing can provide for various undesirable effects such as the piston hitting an end portion of a wall structure within the reciprocating tool. It is to be appreciated that the structure may be designed so that the piston can never hit an end portion of a wall even with the most radical change of timing, but with such a structure the efficiency of the tool is reduced significantly.

The plan which is present in the prior art reciprocating tools also increases the level of vibration during the operation of the tool. The higher the level of vibration in the tool, the greater the fatigue which is produced to the operator of the tool. In addition, when the level of vibration is high, the tool is hard to hold and control and the tool does not provide for a smooth operation. Eventually the vibration produced as the tool is operated creates additional wear in the tool thereby leading to the tool wearing out more rapidly than if the tool had a lower level of vibration. The various effects described above with reference to prior art reciprocating tools, which include gears and levers, may be reduced somewhat by the proper balancing of various elements in the tool. However, the effects will still occur even with a proper balancing since the play inherently defeats all attempts to reduce the vibration below a particular level in the reciprocating tool.

The present invention provides for an improved air operated tool wherein the various elements such as the piston and the tool holder are interconnected for a transfer of reciprocating motion without the use of gears or levers. Specifically, with the air operated reciprocating tool of the present invention, a belt structure is used to interconnect the piston with the tool holder and provide for the transfer of motion to the tool holder in accordance with the reciprocation of the piston. The interconnecting belt structure forms a loop and with the belt structure preloaded so that the loop is in tension.

In a particular embodiment of the invention, the belt structure includes two belt members and with each belt member extending from opposite ends of a single piston and with the belt members preloaded to provide for the tension in the loop. Each belt member passes over and is supported by a pulley located adjacent to the ends of the piston. The belt members are relatively thin so that the belt members flex easily during the transmittal of motion. In a preferred embodiment of the invention the belt members may be constructed of a plastic material and with each belt member formed by a number of separate individual layers of thin plastic material. In particular, the belt members may be composed of a mylar polyester since this material has memory and when stretched this material produces forces tending to pull the material back to its original size.

The present invention also provides for a valving assembly for controlling the reciprocation of the piston from a central position within the piston. Specifically, the single piston is split into two spaced piston halves and with the spaced piston halves interconnected by a rod member. The valving assembly is located between the spaced halves of the split piston and with inner surfaces of the split piston directly operating a movable valve portion of the valving assembly. Specifically, the valve portion is located within an opening in a valve body and with the valve portion having relieved section for providing the valving to control the reciprocation of the split pistons.

The valving assembly of the present invention is extremely simple and directly uses the innersurfaces of the split piston to provide for a direct control of the valving assembly. Since the valving assembly is directly controlled by the piston, this additionally provides for an accurate timing of the valving assembly so the piston may be designed to come very close to the walls of the valve body without hitting. As indicated above, it is desirable to have the piston come close to the walls without hitting since this provides for both maximum speed and stroke for the reciprocating tool which in turn produces increased efficiency.

In the air operated reciprocating tool of the present invention the reciprocating piston is completely floating and does not receive a load perpendicular to the direction of movement of the piston. A load perpendicular to the piston will occur if the piston is interconnected to other elements in the tool such as with gearing. Since the piston is completely floating it has a long operating life and does not provide for variations in the timing of the valving structure.

A clearer understanding of the invention will be had with reference to the following description and drawings wherein FIG. 1 illustrates a perspective view of an air operated reciprocating tool of the present invention;

Figure 1:
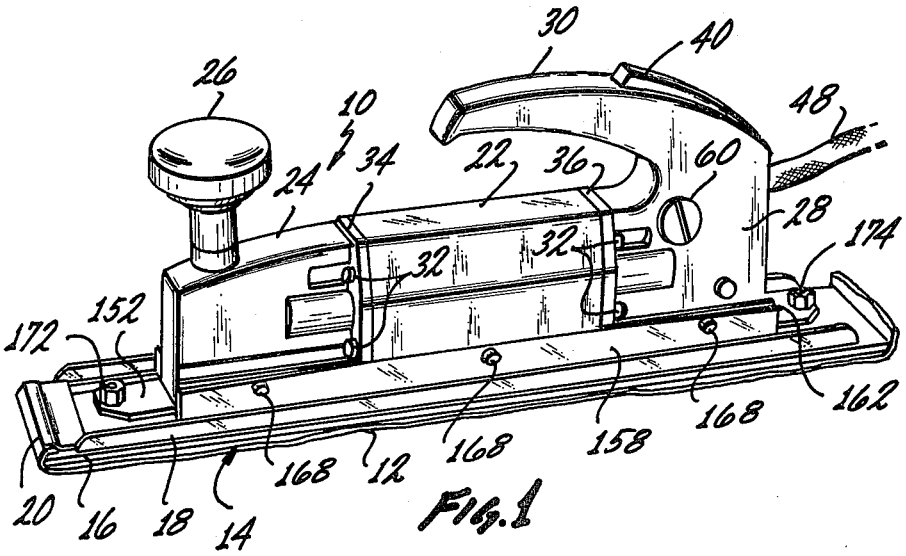

FIG. 1 illustrates a perspective view of an air operated reciprocating tool 10 constructed in accordance with the teachings of the present invention. Specifically in FIG. 1 the air operated reciprocating tool 1 is shown to provide for a sanding operation since an abrasive layer of material 12 is shown attached to the bottom surface of a reciprocating tool holder 14. The tool holder 14 includes a resilient pad 16 supported by a flange member 18. A clamp structure 20 provides clamping of the abrasive material 12 at the front end of the tool holder 14. It is to be appreciated that the tool holder 14 may be replaced with other types of tool holders so as to support tools to provide for other operations such as filing, sawing, etc.

The body of the air operated tool 10 is formed by three interconnected portions. Specifically, the body includes a central body portion 22 for receiving the piston and valving structure, a nose portion 24 which includes a a support knob 26 and a handle portion 28 which includes the handle 30. The three separate portions 22, 24 and 28 forming the body of the tool 10 are held together by screw members 32 which extend through openings in flanged sections 34 and 36 of the body portions 24 and 28 and which are received in tapped openings in the central body portion 22. For example, in FIG. 5 tapped openings 38 are shown which openings receive the screws 32 to hold the handle portion 28 against the central body portion 22.

Figure 2:
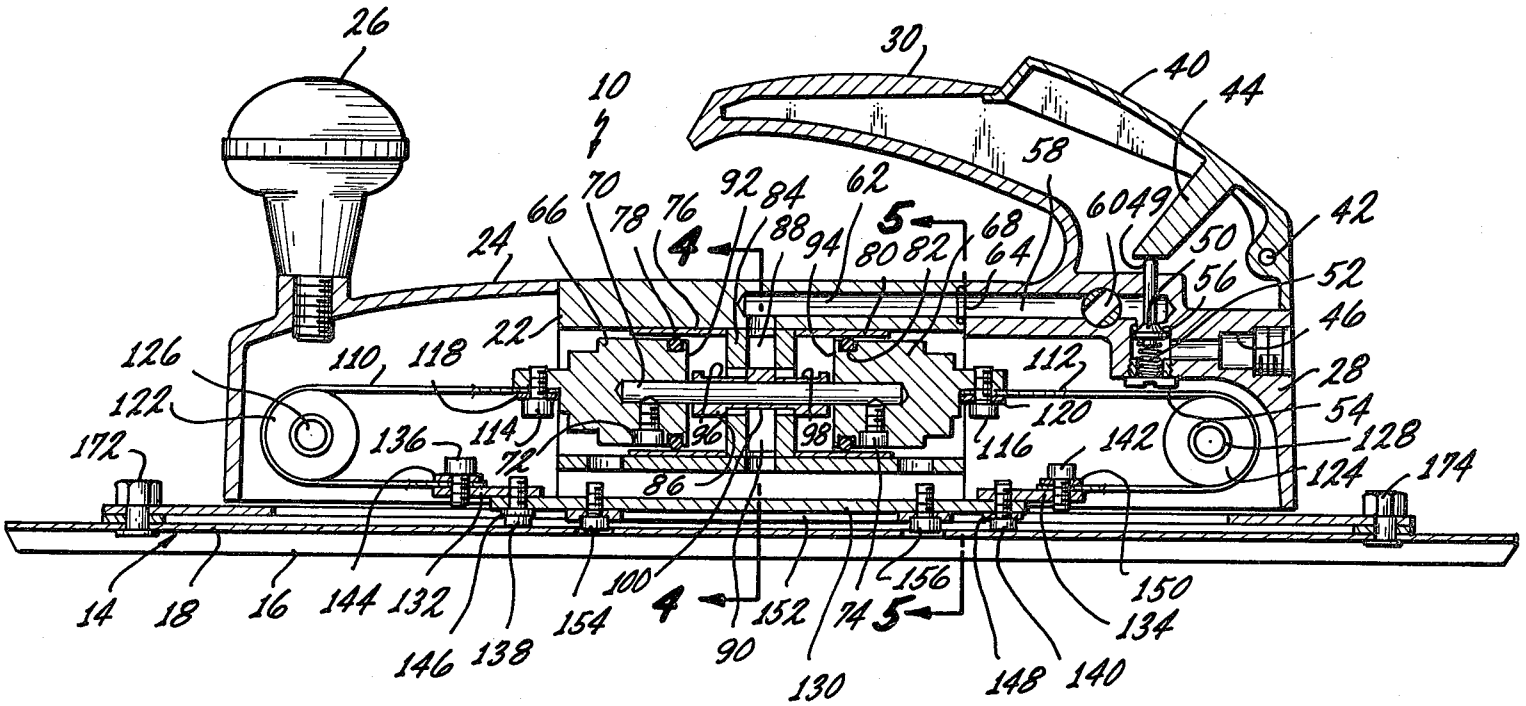
FIG. 2 is a cross-sectional view of the reciprocating tool of FIG. 1.

The handle portion 28 includes a trigger member 40 to control the on-off operation of the air operated tool. As shown in FIG. 2 the trigger member 40 is pivoted about a pivot point 42 and the trigger member 40 includes a post 44 which extends downward to control an on-off valve to control the application of air to the air operated tool. An opening 46 having a threaded end receives a standard coupling at the end of an air line 48 shown in FIG. 1. Air, such as compressed air is therefore coupled to the tool 10 through the opening 46. The air passes to an on-off valve including a valve stem 49 supporting a valve portion 50. The on-off valve is spring loaded in an upward direction by a helical spring 52 and which spring is retained in position by a plug member 54.

In the position of the on-off valve assembly shown in FIG. 2 the valve portion 50 seals the air passage against an O-ring 56. Air is therefore prevented from passing into the interior of the air operated tool 10 and specifically to a passageway 58 in the handle body portion 28. When the trigger 40 is pushed downward the post 44 provides for downward movement of the valve stem 49 and therefore the valve portion 50 so as to allow for passage of air from the passageway 46 to the passageway 58. A rotatable control member 60 provides for the control of the air pressure by constricting the passageway 58 in accordance with the rotational position of the control member 60.

The air in the passageway 58 is passed into a passageway 62 in the central body portion 22. An O-ring seal 64 maintains a fluid seal between the passageway 58 and 62. The passageway 62 leads into the valving assembly for the reciprocating air tool 10 of the present invention. In particular, the valving assembly is located within a single split piston. The single split piston is formed of two piston halves 66 and 68 and with a rod member 70 interconnecting the piston halves 66 and 68. Set screws 72 and 74 lock the piston halves 66 and 68 on the rod 70. The single split piston rides within a cylindrical bore and specifically piston half 66 rides within a first cylindrical member 76 and with a seal 78 providing a seal between the piston half and the cylindrical member 76. Piston half 68 rides within a second cylindrical member 80 and with seal 82 providing for a seal between the piston half and the cylindrical member 80.

The valving assembly includes a fixed valve body 84 and a movable valve 86 which rides within a central opening in the valve body 84. An inlet passageway 88 couples the air in the passageway 62 to enter into the valving assembly and an exit passageway 90 provides for an exhaust of the air from the valving assembly. As can be seen in the drawings, as the split piston formed by the two half pistons 66 and 68 move in unison within the cylindrical members 76 and 80, inner surfaces 92 and 94 of each half piston contact the opposite ends of the valve 86 to provide for a direct control of the valving of the air operated tool during reciprocation of the split piston.

Figure 3:
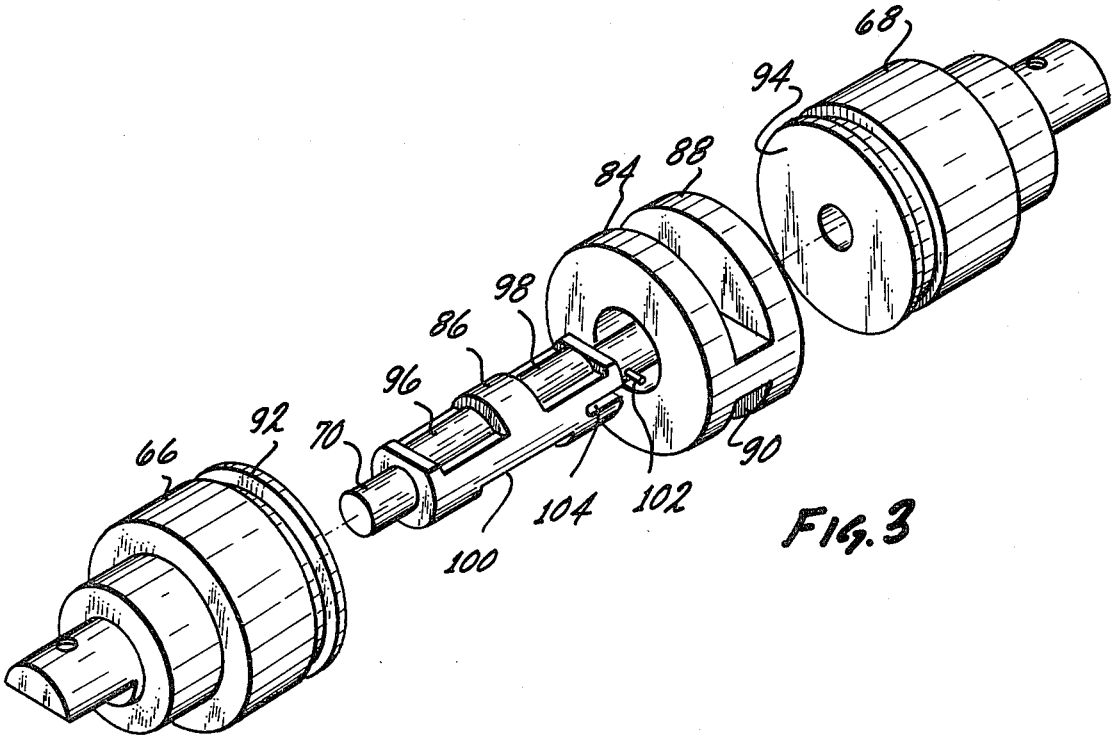
FIG. 3 is an exploded view of the single split piston and the valving assembly for the tool of the present invention.

The valve body 84 has an H shaped cross-section and with the central opening for receiving the valve 86. The passageways 88 and 90 are formed by slots which provide for the inlet and the exhaust of the air. This can be seen clearly with reference to FIG. 3. The valve 86 includes two inlet cutaway sections 96 and 98 on one side of the valve 86 adjacent to the inlet passageway 88 of the valve body 84. The opposite side of the valve 86 includes an exhaust cutaway section 100 which is adjacent the exhaust passageway 90 of the valve body 84. A pin 102 extends from the rod 70 to fit within a slot 104 in the valve 86 and prevents the valve 86 from rotating around the rod 70 during operation.

Figure 6:
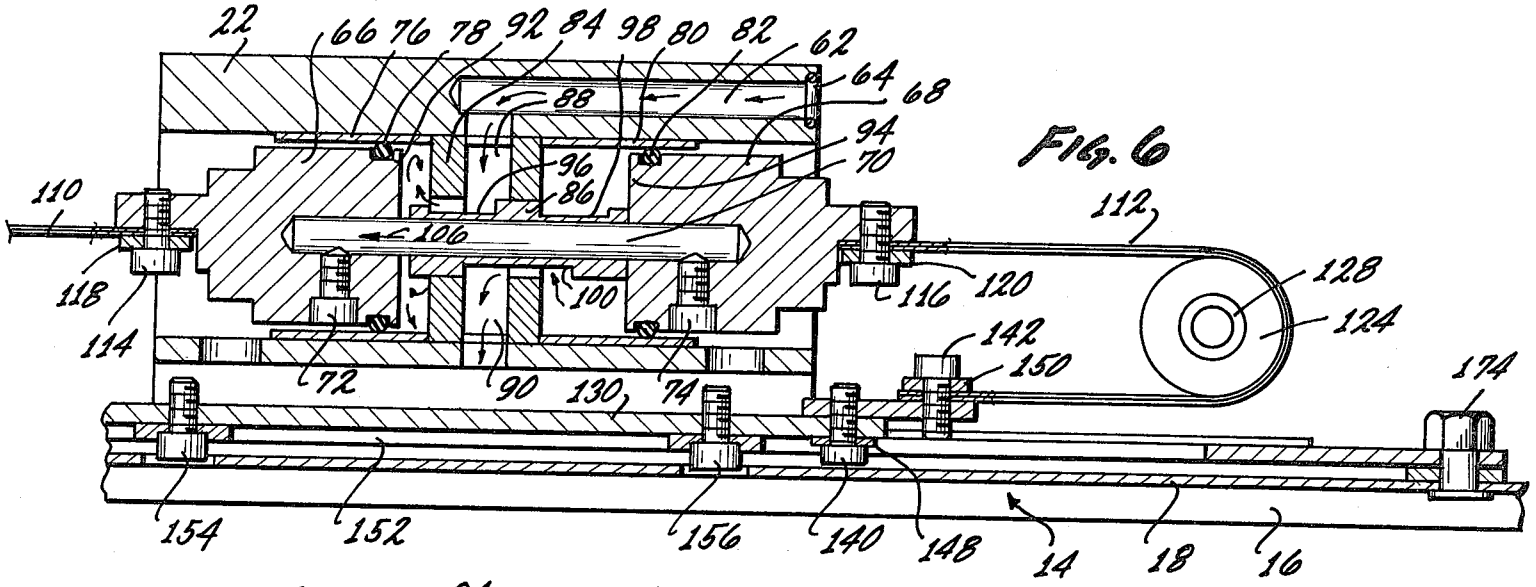
FIG. 6 is a cross-sectional view showing the valving in a first position.
Figure 7:
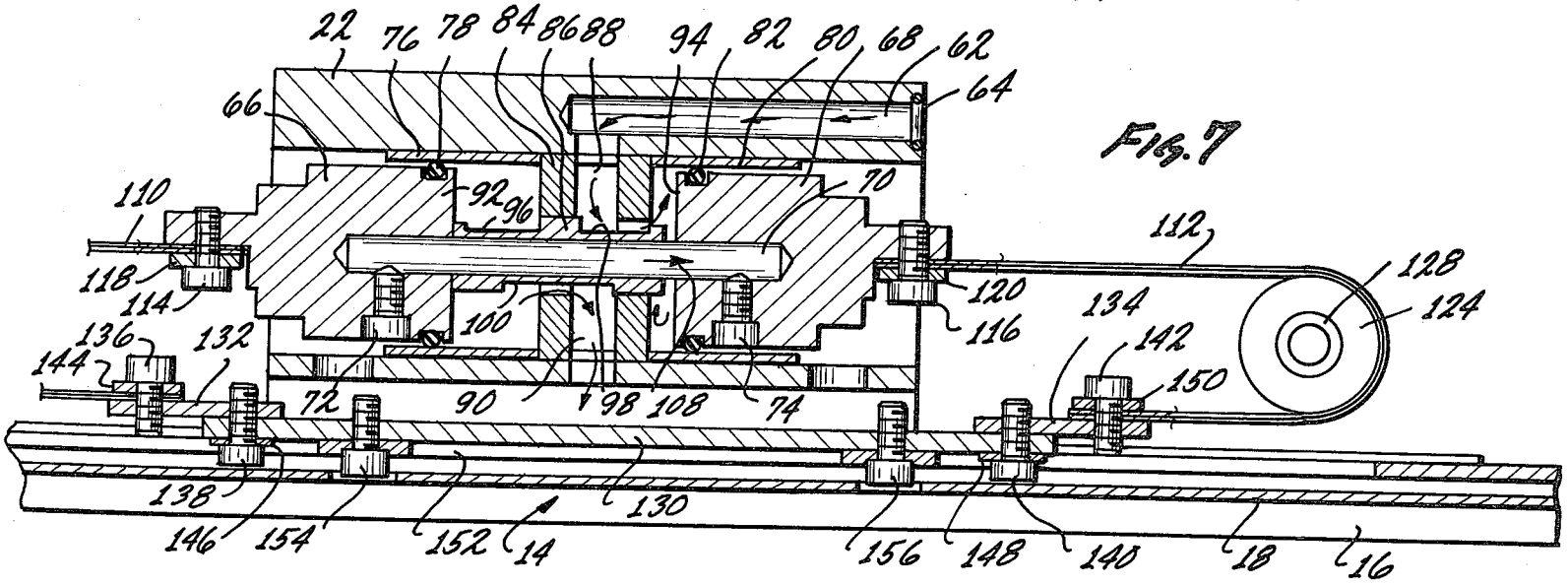
FIG. 7 is a cross-sectional view showing the valving in a second position opposite to the second position.

The operation of the valving assembly and the reciprocating movement of the split piston may be clearly seen with reference to FIGS. 6 and 7 which show the relationship of the various elements initially after the beginning of each stroke and also in FIG. 2 which shows the elements in a central position. As shown in FIG. 6, the compressed air comes through the passageway 62 into the inlet portion 88 of the valve body 84. The single split piston has just started its stroke in one direction and is moving in the direction shown by the arrow 106. The compressed air passes through the inlet portion 88 and between the valve 86 and valve body 84 through the recessed section 96 and into a first chamber adjacent the inner surface 92 of the piston half 66. The inner surface 94 of the piston half 68 is at this time pushing one end of the valve 86 in the direction of the arrow 106. Air is exhausted from a second chamber adjacent the inner surface 94 of the piston half 68 between the valve 86 and the valve body 84 through the recessed section 100 of the valve 86 and into the exhaust portion 90 of the valve body 84. FIG. 6 therefore shows the various elements shortly after the piston has reversed direction to move in the direction shown by the arrow 106. Just prior to the reversal of direction the inner surface 92 would come close to but would not quite touch the wall of the valve body 84.

As the piston continues in the direction shown by the arrow 106 the second chamber continues to be exhausted while compressed air is supplied to the first chamber. The various elements will then go through a central position as shown generally in FIG. 2 wherein both the inlet and exhaust are momentarily cut off but the momentum of the piston carries the piston through the central position to reverse the inlet and exhaust in the first and second chambers. The single split piston continues in the direction shown by the arrow 106 and slows down and momentarily stops at the position where the inner surface 94 is just short of the wall of the valve body 84. The split piston then reverses direction to the direction shown by the arrow 108 in FIG. 7 and the operation of the tool continues but in the new direction. Specifically as shown in FIG. 7 air is exhausted from the first chamber through the recessed section 100 of the valve 86 to the exhaust portion 90 of the valve body 84. Also the air passes from the inlet portion 88 of the valve body 84 and through the recessed portion 98 of the valve 86 into the second chamber adjacent the inner surface 94 of the half piston 68. The reciprocation of the piston continues back and forth as long as compressed air is applied to the reciprocating tool.

It can be seen in FIGS. 6 and 7 that when one of the inner surfaces 92 or 94 is in engagement with one end of the valve 86 there is a small spacing between the other end of the valve and the other inner surface. This spacing produces a slight off center operation between the split piston and the valving assembly so that the tool cannot stall in a center position under load. Also, FIG. 2 illustrates the valve 86 spaced from both inner surfaces 92 and 94 of the split piston but in normal operation the tool will not stop in this position. Normally, the tool will stop so that one of the first or second chambers will have a greater volume than the other so that the tool will start even when in a substantially central position. Moreover, the tool can always be made to start by moving the tool holder slightly to move the internal elements in an off-center position.

Figure 5:
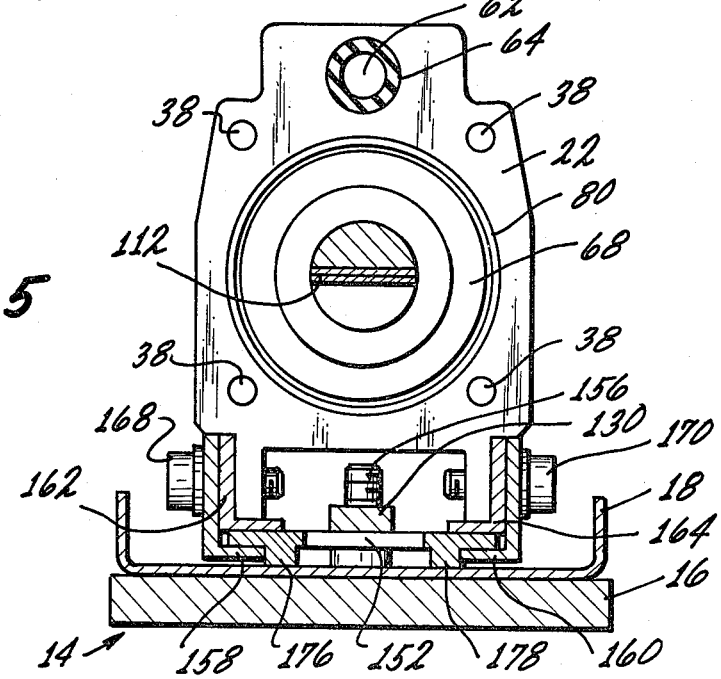
FIG. 5 is a cross-sectional view taken along lines 5—5 of FIG. 2.

The reciprocating movement of the single split piston is transmitted to the tool holder 14 through the use of a belt assembly. Specifically, a first belt member 110 is attached to an end portion of the half piston portion 66 and a second belt member 112 is attached to an end portion of the half piston portion 68. In a preferred embodiment of the invention, the belts 110 and 112 are formed from a plurality of individual layers of material. As shown in FIGS. 5, 6 and 7, two such separate layers of material may be used to form the belt but it is to be appreciated that even a greater number of layers may be used. The use of a plurality of separate layers of material to form the belts provides for a greater flexibility in the belts while at the same time producing the desired strength necessary to transmit the forces during the operation of the tool. The individual layers may be formed of a high strength plastic material such as a "Mylar" polyester or a urethane.

The ends of the belts 110 and 112 are attached to the half piston portions 66 and 68 of the single split piston using screw members 114 and 116 and clamping washers 118 and 120. The belts 110 and 112 pass around pulleys 122 and 124 which pulleys are supported on shafts 126 and 128. The free ends of the belts 110 and 112 are connected together using a belt strap 130. In particular, the ends of the belts 110 and 112 are interconnected to the strap 130 using buckle members 132 and 134 in combination with bolts 136 through 142 and clamping washers 144 through 150. The belts 110 and 112 in association with the strap 130, the buckles 132 and 134 and the single split piston form a loop. Since the belts 110 and 112 are flexible and will transmit the motion of the piston around the pulleys, the belts may be preloaded so as to maintain the entire loop in tension. This substantially eliminates play between the various elements in the loop which in turn provides for a very precise control of the valving assembly so that the inner surfaces 92 and 94 of the single split piston approach but not hit the walls of the valve body 84. The reduction of play also reduces vibration which in turn produces a smoother, less fatiguing operation of the tool.

Another advantage of the reciprocating tool of the present invention is that the reciprocating motion of the piston is transmitted to the tool using the belts passing around pulleys so that the single split piston is essentially floating and does not receive forces normal to the direction of movement of the piston as may occur with machines including gears. As the single split piston reciprocates so does the strap 130 and the strap 130 is directly connected to a shoe 152 using bolts 154 and 156. It is to be appreciated that the shoe 152 may be formed integrally with the strap 130 so that one element serves two functions. In either case, the shoe 152 is coupled to the belt assembly so as to reciprocate in accordance with the reciprocation of the piston.

Figure 4:
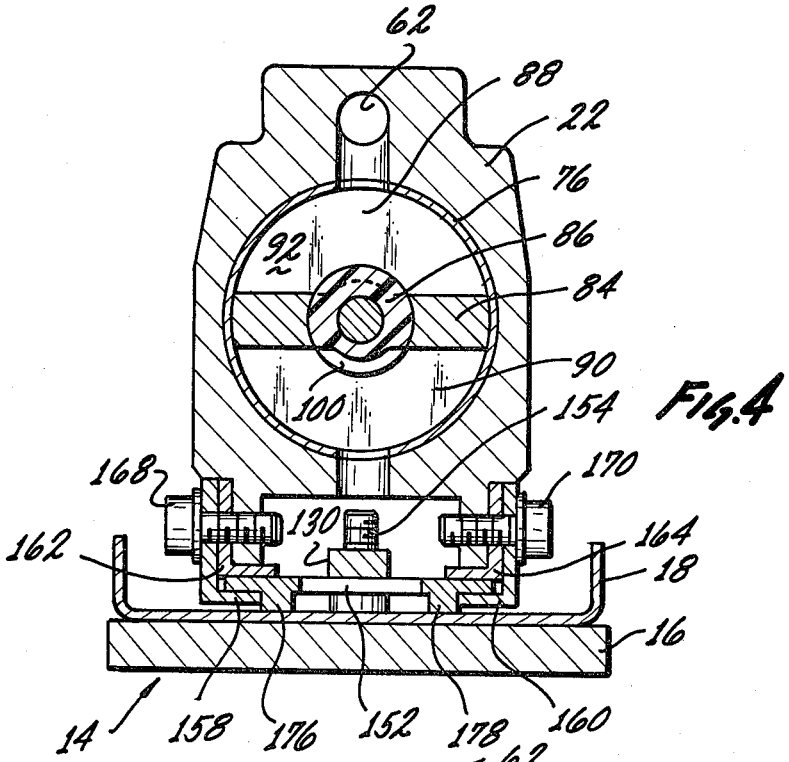
FIG. 4 is a cross-sectional view taken along lines 4—4 of FIG. 2.

As shown in FIGS. 4 and 5, the shoe 152 is supported between lower bearing support strips 158 and 160 and upper bearing support strips 162 and 164. The shoe 152 slides between these bearing support strips and the support strips are fixed in position along the sides of the tool body using bolts 168 and 170. The tool holder 14 is attached to the shoe 152 using nut and bolt structures 172 and 174 and the tool holder is slightly spaced from the bearing strips 158 and 160 by the rib portions 176 and 178 of the shoe 152. The reciprocation of the shoe 152 in accordance with the reciprocation of the piston thereby provides for the reciprocation of the tool holder 14 to provide for the desired operation of the reciprocating tool.

The present invention therefore provides for an air operated reciprocating tool using a single split floating piston with the valving located intermediate the ends of the piston and with inner surfaces of the split piston controlling the operation of the valving and using belts passing around pulleys for transmitting reciprocating motion of the piston to reciprocating motion of a tool holder and which reciprocating tool has a very accurate control of the piston and low vibration because of the substantial elimination of play.

Although the invention has been described with reference to a particular embodiment, it is to be appreciated that various adaptations and modifications may be made and the invention is only to be limited by the appended claims.

I claim:

1. An air operated reciprocating tool, including,
an air operated double ended piston positioned within a cylinder for automatic continuous reciprocation within the cylinder,
a valve assembly operatively actuated by the piston and in communication with a source of air for automatically alternating the control of the application of the source of air to opposite portions of the piston for producing automatic continuous reciprocation of the piston,
a shoe member for supporting a tool and with the shoe member mounted for sliding motion, and
belt means forming a loop for interconnecting the ends of the double ended piston and the shoe member and with the belt means supported by pulley members located adjacent the ends of the double ended piston and with the automatic continuous reciprocating motion of the double ended piston transmitted to automatic continuous reciprocating motion of the shoe member.

2. The air operated reciprocating tool of claim 1 wherein the belt means is preloaded for providing for tension in the loop so as to reduce play during the automatic continuous reciprocating motion.

3. The air operated reciprocating tool of claim 1 wherein the belt means includes at least one flexible belt and with the flexible belt formed by a plurality of individual layers of plastic material.

4. The air operated reciprocating tool of claim 1 wherein the belt means includes two flexible belts interconnected by a strap and with the shoe member coupled to the strap.

5. The air operated reciprocating tool of claim 1 wherein the shoe member is mounted between parallel slides.

6. The air operated reciprocating tool of claim 1 wherein the double ended piston includes two spaced piston halves having inner surfaces and interconnected by a rod located along a center line for the piston halves and with the valve assembly located concentric with the rod and along the center line for the piston halves within the space between the spaced piston halves.

7. The air operated reciprocating tool of claim 6 wherein the valve assembly includes a fixed valve body and a movable valve member and with the movement of the valve member relative to the valve body providing the automatic alternation in air to opposite halves of the double ended piston and with the movement of the valve member directly actuated by the inner surfaces of the spaced piston halves.

8. The air operated reciprocating tool of claim 7 wherein the length of the valve member is less than the distance between the inner surfaces of the spaced piston halves for providing a slight off-center operation for preventing stalling during operation of the tool.

9. The air operated reciprocating tool of claim 7 wherein the valve body has inlet and exhaust passageways for the air and with piston chambers formed on opposite sides of the valve body and with the valve member controlling the automatic alternate passage of air between the inlet and exhaust passageways and the piston chambers.

10. The air operated reciprocating tool of claim 9 wherein the valve body has a slotted cross-section to form the inlet and exhaust passageways and wherein the valve member slides within a central opening in the valve body and wherein the valve member includes a plurality of recesses on opposite sides of the valve member for controlling the automatic alternate passage of air.

11. The air operated reciprocating tool of claim 10 wherein the valve member includes two recesses on one side of the valve member adjacent the inlet passageway and one recess on the other side of the valve member adjacent the exhaust passageway.

12. An air operated reciprocating tool, including, an air operated double ended piston positioned within a cylinder for automatic continuous reciprocation within the cylinder and with the double ended piston including two spaced piston halves having inner surfaces and interconnected by a rod located along a center line for the piston halves, a valve assembly located within the space between the spaced piston halves and operatively actuated by the inner surfaces of the spaced piston halves and concentric with the rod and along the center line and in communication with a source of air for automatically alternating the control of the application of the source of air to the inner surfaces of the two spaced piston halves of the piston for producing automatic continuous reciprocation of the piston and with the valve assembly including a fixed valve body and a movable valve member and with the movement of the valve member relative to the valve body providing the automatic alternation in air to the inner surfaces of the two spaced piston halves and with the movement of the valve member directly actuated by the inner surfaces of the spaced piston halves, a shoe member for supporting a tool and with the shoe member mounted for sliding motion, and means interconnecting the double ended piston and the shoe member and with the automatic continuous reciprocating motion of the double ended piston transmitted to automatic continuous reciprocating motion of the shoe member.

13. The air operated reciprocating tool of claim 12 wherein the length of the valve member is less than the distance between the inner surfaces of the spaced piston halves for providing a slight off-center operation for preventing stalling during operation of the tool.

14. The air operated reciprocating tool of claim 12 wherein the valve body has inlet and exhaust passageways for the air and with piston chambers formed on opposite sides of the valve body and with the valve member controlling the automatic alternate passage of air between the inlet and exhaust passageways and the piston chambers.

15. The air operated reciprocating tool of claim 14 wherein the valve body has a slotted cross-section to form the inlet and exhaust passageways and wherein the valve member slides within a central opening in the valve body and wherein the valve member includes a plurality of recesses on opposite sides of the valve member for controlling the automatic alternate passage of air.

16. The air operated reciprocating tool of claim 15 wherein the valve member includes two recesses on one side of the valve member adjacent the inlet passageway and one recess on the other side of the valve member adjacent the exhaust passageway.

17. The air operated reciprocating tool of claim 12 additionally including belt means forming the means for interconnecting and with the belt means interconnecting the ends of the double ended piston and the shoe member and with the belt means supported by pulley members located adjacent the ends of the double ended piston.

18. The air operated reciprocating tool of claim 17 wherein the belt means is preloaded for providing for tension in the loop so as to reduce play during the reciprocating motion.

19. The air operated reciprocating tool of claim 17 wherein the belt means includes at least one flexible belt and with the flexible belt formed by a plurality of individual layers of plastic material.

20. The air operated reciprocating tool of claim 17 wherein the belt means includes two flexible belts interconnected by a strap and with the shoe member coupled to the strap.

21. The air operated reciprocating tool of claim 17 wherein the shoe member is mounted between parallel slides.

* * * * *